US011114784B2

(12) United States Patent
Naito

(10) Patent No.: US 11,114,784 B2
(45) Date of Patent: Sep. 7, 2021

(54) ELECTRICAL CONNECTOR STRUCTURE

(71) Applicant: TOYOTA JIDOSHA KABUSHIKI KAISHA, Toyota (JP)

(72) Inventor: Saki Naito, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/808,510

(22) Filed: Mar. 4, 2020

(65) Prior Publication Data

US 2020/0321717 A1 Oct. 8, 2020

(30) Foreign Application Priority Data

Apr. 4, 2019 (JP) ..... JP2019-072154

(51) Int. Cl.

| | |
|---|---|
| ***H01R 13/11*** | (2006.01) |
| ***H01R 12/71*** | (2011.01) |
| ***H01R 13/627*** | (2006.01) |
| ***H01R 13/635*** | (2006.01) |
| ***H01R 13/502*** | (2006.01) |
| ***H01R 13/533*** | (2006.01) |

(52) U.S. Cl.

CPC ..... *H01R 12/716* (2013.01); *H01R 13/11* (2013.01); *H01R 13/502* (2013.01); *H01R 13/533* (2013.01); *H01R 13/627* (2013.01); *H01R 13/635* (2013.01); *H01R 2201/26* (2013.01)

(58) Field of Classification Search

CPC .. H01R 12/716; H01R 13/627; H01R 13/635; H01R 13/502; H01R 13/11; H01R 13/533; H01R 2201/26; H01R 13/055; H01R 12/7076; H01R 12/91; H01R 13/05; H01R 24/005

See application file for complete search history.

(56) References Cited

U.S. PATENT DOCUMENTS

| | | | | |
|---|---|---|---|---|
| 9,022,817 | B2 * | 5/2015 | Endo | H01R 13/112 439/857 |
| 9,991,617 | B2 * | 6/2018 | Pitten | H01R 13/42 |
| 10,498,082 | B2 * | 12/2019 | Suzuki | H01R 13/502 |
| 2012/0003856 | A1 * | 1/2012 | Yamaguchi | H01R 13/5202 439/271 |

(Continued)

FOREIGN PATENT DOCUMENTS

| | | | |
|---|---|---|---|
| JP | 2015-146289 | A | 8/2015 |
| JP | 2016-189274 | A | 11/2016 |

*Primary Examiner* — Truc T Nguyen

(74) *Attorney, Agent, or Firm* — Oliff PLC

(57) ABSTRACT

A connector structure configured to electrically connect an electrical component to a circuit board is disclosed. The connector structure may include a female connector secured to the circuit board; and a male terminal extending from the electrical component and inserted into the female connector. The female connector may include a connector housing secured to the circuit board; a connector-side terminal located within the connector housing and including a female contact configured to receive the male terminal; and a contact sleeve located within the connector housing and secured to the female contact. The female contact may be displaceable within the connector housing. The male terminal may be deformed so as to press the contact sleeve against a frictional inner surface of the connector housing by a restoring force of the male terminal.

10 Claims, 4 Drawing Sheets

(56) References Cited

U.S. PATENT DOCUMENTS

| | | | | |
|---|---|---|---|---|
| 2013/0084751 | A1* | 4/2013 | Shindo | H01R 13/533 439/626 |
| 2014/0308851 | A1* | 10/2014 | Shindo | H01R 13/629 439/625 |
| 2015/0147903 | A1* | 5/2015 | Noguchi | H01R 13/631 439/374 |
| 2015/0222046 | A1 | 8/2015 | Akiguchi et al. | |
| 2016/0294100 | A1* | 10/2016 | Shindo | H01R 13/635 |
| 2017/0207550 | A1* | 7/2017 | Genta | H01R 43/027 |
| 2018/0241155 | A1* | 8/2018 | Suzuki | H01R 13/502 |
| 2019/0123464 | A1* | 4/2019 | Pucher | H01R 12/87 |

* cited by examiner

ELECTRICAL CONNECTOR STRUCTURE

CROSS-REFERENCE

This application claims priority to Japanese Patent Application No. 2019-072154 filed on Apr. 4, 2019, the contents of which are hereby incorporated by reference into the present application.

TECHNICAL FIELD

The technology disclosed herein relates to a connector structure configured to electrically connect an electrical component to a circuit board.

BACKGROUND

Japanese Patent Application Publication No. 2015-146289 describes a connector structure configured to electrically connect an electrical component to a circuit board. This connector structure includes a male terminal provided on the electrical component and a female connector provided on the circuit board, and the male terminal is inserted into the female connector. The female connector includes a connector-side terminal and a connector housing that houses the connector-side terminal. The connector-side terminal includes a female contact configured to receive the male terminal.

SUMMARY

Plate-shaped circuit boards tend to easily vibrate under an external force, and may cause resonance. In this regard, in the above-described connector structure, the female contact of the connector-side terminal is displaceable with respect to the connector housing. This can suppress transmission of the vibration of the circuit board to the electrical component. On the other hand, it is difficult to reduce the vibration of the circuit board itself.

In view of the foregoing, the present disclosure provides a technique for a connector structure that can reduce or suppress vibration of a circuit board.

A connector structure disclosed herein may be configured to electrically connect an electrical component to a circuit board. The connector structure may include a female connector provided on the circuit board and a male terminal provided on the electric component. The male terminal is inserted into the female connector. The female connector may include a connector housing secured to the circuit board, a connector-side terminal including a female contact configured to receive the male terminal, and a contact sleeve secured to the female contact. The connector-side terminal and the contact sleeve are located within the connector housing. The female contact of the connector-side terminal may be displaceable with respect to the connector housing. The male terminal may be elastically deformed such that the contact sleeve is pressed against an inner surface of the connector housing by a restoring force of the male terminal. The inner surface generates a friction force when the contact sleeve moves with respect to the connector housing.

In the connector structure described above, the female contact of the connector-side terminal is displaceable with respect to the connector housing. Thus, when vibration occurs in the circuit board, transmission of the vibration from the circuit board to the electrical component is suppressed. In addition, the male terminal connected to the female contact is deformed, and the restoring force of the male terminal works on the female contact and the contact sleeve. The restoring force of the male terminal presses the contact sleeve against the inner surface of the connector housing. When vibration occurs in the circuit board and the contact sleeve relatively displaces on the connector housing, a friction force is generated between the contact sleeve and the connector housing. The vibration of the circuit board is damped by this friction force. The connector structure disclosed herein can reduce or absorb the vibration generated in the circuit board, as well as can suppress the vibration transmission from the circuit board to the electrical component and the vibration transmission from the electrical component to the circuit board.

DETAILED DESCRIPTION

In one embodiment of the present technique, the connector housing may further comprise other inner surface opposing to the frictional inner surface. A portion of the male terminal that is located on electrical component side may be located on frictional inner surface side. Another portion of the male terminal that is located on female contact side may be located on other inner surface side.

In one embodiment of the present technique, an opening may be provided in the circuit board. The male terminal may be inserted into the female connector through the opening. In this case, a longitudinal direction of the male terminal may be substantially perpendicular to the circuit board. The term "substantially perpendicular" as used herein means a range of ±10 degrees with respect to vertical (i.e., 90 degrees).

In one embodiment of the present technique, the connector-side terminal may comprise a distal end portion at which the female contact is provided, a proximal end portion secured to the connector housing, and a plate spring portion extending between the distal end portion and the proximal end portion. With such a configuration, the female contact can be held displaceably with respect to the connector housing by a relatively simple configuration.

In one embodiment of the present technique, the plate spring portion may have a U-shape. However, the specific structure of the connector-side terminal, including the plate spring portion, is not particularly limited.

In one embodiment of the present technique, one or both of the contact sleeve and the connector housing may be constituted of resin. According to such a configuration, an appropriate friction force can be generated between the contact sleeve and the connector housing. However, in other embodiments, one or both of the contact sleeve and the connector housing may be constituted of other insulators, not resin.

In one embodiment of the present technique, the connector housing may comprise a base housing secured to the circuit board and a main housing slidable with respect to the base housing.

In one embodiment of the present technique, the proximal end portion of the connector-side terminal may be secured to the main housing.

Embodiment

A connector structure 10 of an embodiment will be described with reference to the drawings. The connector structure 10 of the present embodiment is used to electrically connect an electrical component 2 to a circuit board 4. For example, the connector structure 10 is employed in a power regulation unit of an electric vehicle, and detachably connects the electrical component 2 such as a semiconductor module to the circuit board 4. However, the use application of the connector structure 10 is not particularly limited. The connector structure 10 can be employed in a variety of devices and equipment.

Figure 1:
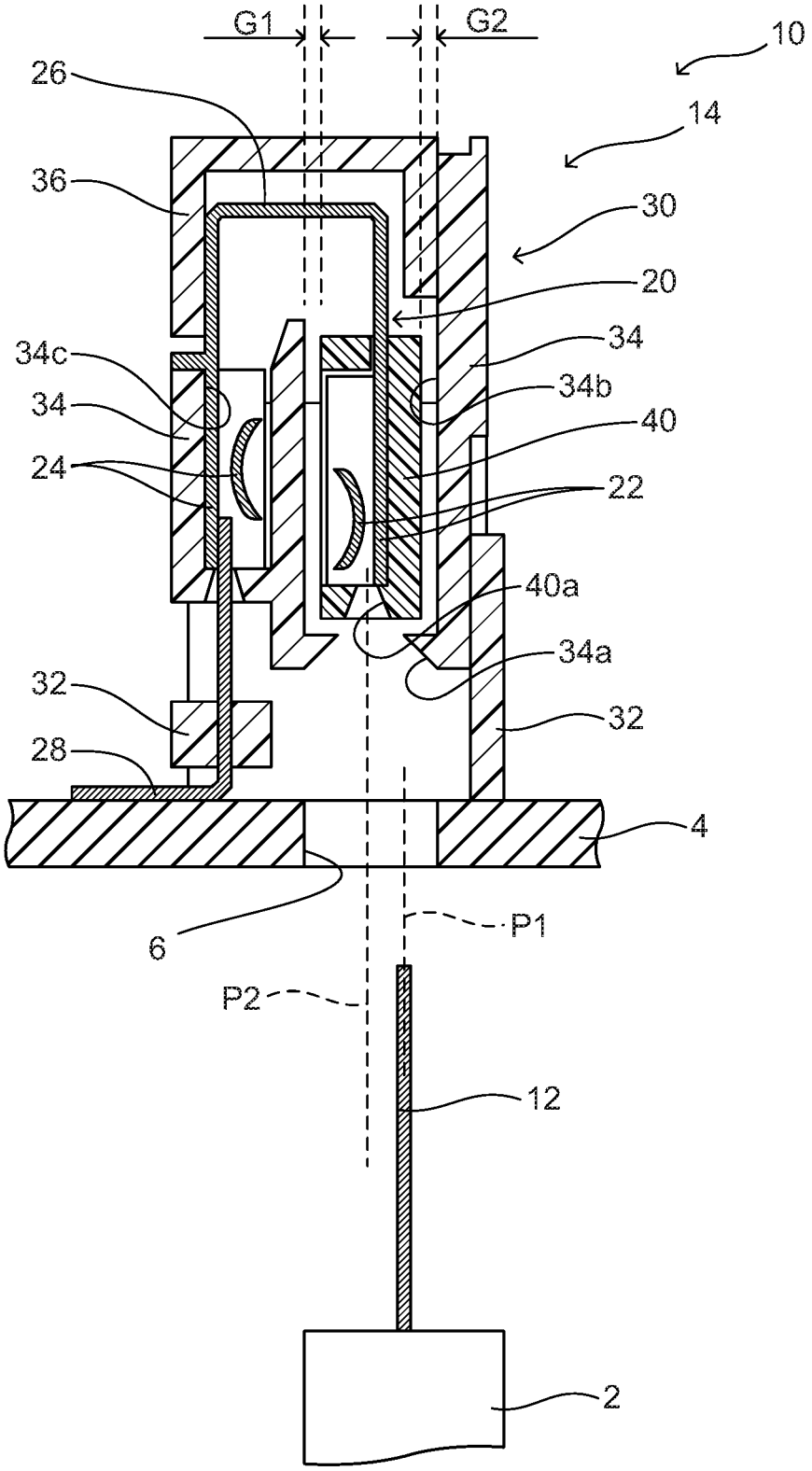
FIG. 1 is a cross-sectional view schematically showing a connector structure 10 of an embodiment and shows a state before a male terminal 12 is inserted into a female connector 14.
Figure 2:
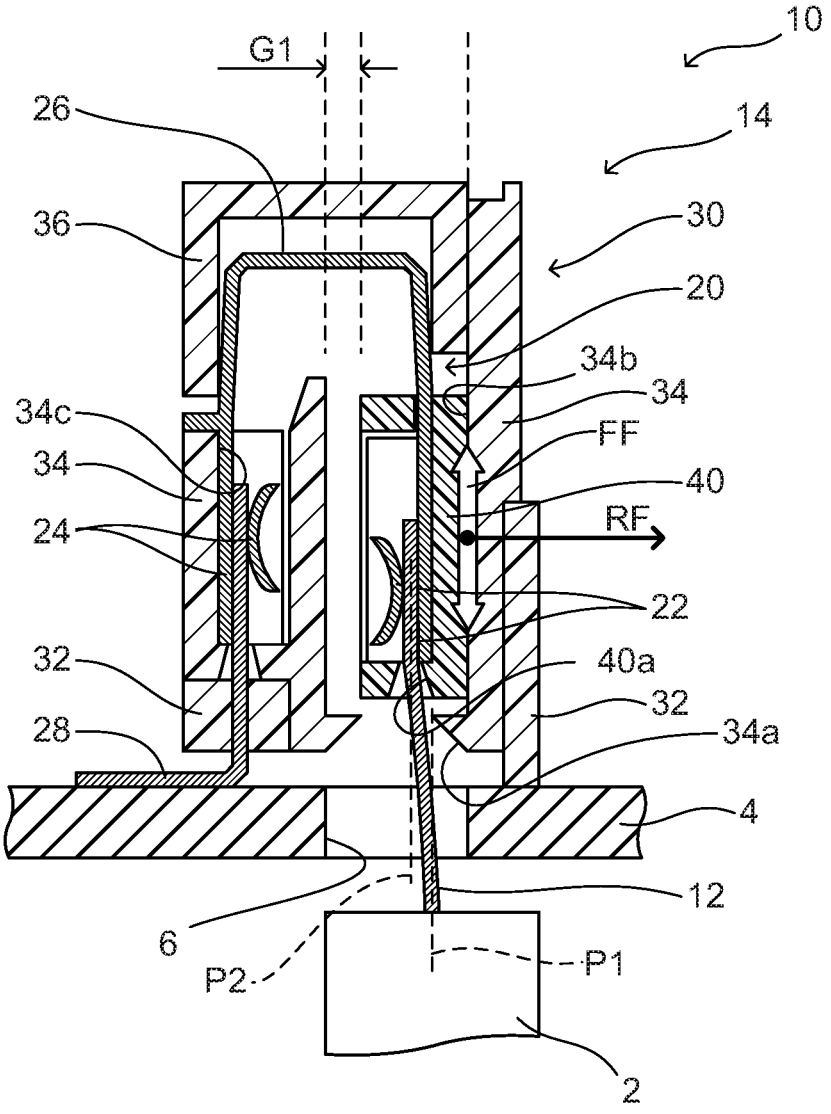
FIG. 2 is a cross-sectional view schematically showing the connector structure 10 of the embodiment and shows a state after the male terminal 12 is inserted into the female connector 14.

FIGS. 1 and 2 schematically show a structure of the connector structure 10. As shown in FIGS. 1 and 2, the connector structure 10 includes a male terminal 12 and a female connector 14. The male terminal 12 is provided on the electrical component 2, and the female connector 14 is provided on the circuit board 4. The male terminal 12 is constituted of a conductive material such as metal (e.g., copper). The male terminal 12 has an elongated pin shape and projects from the electrical component 2 toward the circuit board 4. Although not particularly limited, the male terminal 12 may be substantially perpendicular to the circuit board 4. The male terminal 12 is inserted into the female connector 14 through an opening 6 provided in the circuit board 4.

The female connector 14 includes a connector-side terminal 20, a connector housing 30, and a contact sleeve 40. The connector-side terminal 20 is constituted of a conductive material such as metal (e.g., copper). The connector-side terminal 20 includes a first female contact 22, a second female contact 24, and a plate spring portion 26. The first female contact 22 is positioned at a distal end of the connector-side terminal 20 and receives the male terminal 12 inserted into the female connector 14.

The second female contact 24 is positioned at a proximal end of the connector-side terminal 20 and is secured to the connector housing 30. The second female contact 24 is coupled to a board-side terminal 28 soldered to the circuit board 4, and is electrically connected to the circuit board 4 via the board-side terminal 28. The plate spring portion 26 extends between the first female contact 22 and the second female contact 24. The plate spring portion 26 is elastically deformable, and holds the first female contact 22 displaceably with respect to the connector housing 30. Although not particularly limited, the plate spring portion 26 in the present embodiment has a U-shape.

The connector housing 30 houses the connector-side terminal 20, and is secured to the circuit board 4 by soldering. Although not particularly limited, the connector housing 30 is constituted of an insulator such as resin. The specific structure of the connector housing 30 is not particularly limited. The connector housing 30 of the present embodiment includes a base housing 32 secured to the circuit board 4, a main housing 34 detachably attached to the base housing 32, and a top housing 36 detachably attached to the main housing 34, although this is a mere example. The main housing 34 and the top housing 36 are vertically slidable with respect to the base housing 32.

The contact sleeve 40 is located inside the connector housing 30 and is attached to the first female contact 22 of the connector-side terminal 20. The contact sleeve 40 at least partially covers the first female contact 22, and prevents the first female contact 22 from directly contacting the connector housing 30. Although not particularly limited, the contact sleeve 40 is constituted of an insulator such as resin. The material of the contact sleeve 40 may be the same as or different from the material of the connector housing 30.

As shown in FIG. 1, before the male terminal 12 is inserted into the female connector 14, the connector-side terminal 20 (particularly, the plate spring portion 26) in the female connector 14 has its natural shape. In this state, gaps G1 and G2 are present on both sides of the contact sleeve 40, and the first female contact 22 and the contact sleeve 40 can freely displace with respect to the connector housing 30. Before the male terminal 12 is inserted into the female connector 14, the main housing 34 and the top housing 36 is slid upward relative to the base housing 32. From this state, the main housing 34 and the top housing 36 are slid downward to the base housing 32, by which the male terminal 12 is inserted into the female connector 14. In prior art, the male terminal 12 is inserted into the female connector 14, with a position P1 of the male terminal 12 aligned with a position P2 of the first female contact 22. However, in the present embodiment, the male terminal 12 is inserted into the female connector 14, with the position P1 of the male terminal 12 offset from the position P2 of the first female contact 22. The main housing 34 is provided with an inclined surface 34*a* at its lower end, and the contact sleeve 40 is provided with an inclined surface 40*a* at its lower end. When the male terminal 12 is moved up to the first female contact 22, the inclined surfaces 34*a* and 40*a* contact a tip of the male terminal 12 and guide the tip of the male terminal 12 to the position of the first female contact 22.

As a result, as shown in FIG. 2, the male terminal 12 is inserted into the female connector 14. As shown in FIG. 2, the male terminal 12 inserted into the female connector 14 flexes and deforms in a direction parallel to the circuit board 4 (in a leftward direction in FIG. 2). The main housing 34 includes a right inner surface (frictional inner surface) 34*b* and a left inner surface 34*c*. The male terminal 12 deforms such that a portion of the male terminal 12 that is closer to the electrical component 2 is located closer to the frictional inner surface 34*b*, and another portion of the male terminal 12 that is closer to the first female contact 22 is located closer to the inner surface 34*c*. In this state, the male terminal 12 is under a restoring force thereof that works to return the male terminal 12 to the straight shape. The contact sleeve 40 is pressed against the frictional inner surface 34*b* of the connector housing 30 by the restoring force of the male terminal 12. In FIG. 2, the gap G2 on one side of the contact sleeve 40 disappears, and an arrow RF indicates the pressing force to the contact sleeve 40 against the frictional inner surface 34*b*. As such, when vibration occurs in the circuit board 4, the contact sleeve 40 displaces relative to the connector housing 30, by which a friction force FF is generated between the contact sleeve 40 and the connector housing 30. The vibration of the circuit board 4 is damped by the friction force FF. As described above, the connector structure 10 of the present embodiment can reduce vibration occurring in the circuit board 4 as well as can suppress transmission of the vibration from the circuit board 4 to the electrical component 2.

In addition, when the friction force FF is generated between the contact sleeve 40 and the connector housing 30, a natural frequency of the circuit board 4 is increased. Normally, the circuit board 4 is supported via a plurality of vibration isolation bushings. Since a damping rate of the vibration isolation bushings is high in a high frequency range (for example, in a range of 400 hertz or more), resonance of the circuit board 4 can be effectively suppressed by increasing the natural frequency of the circuit board 4.

Figure 3:
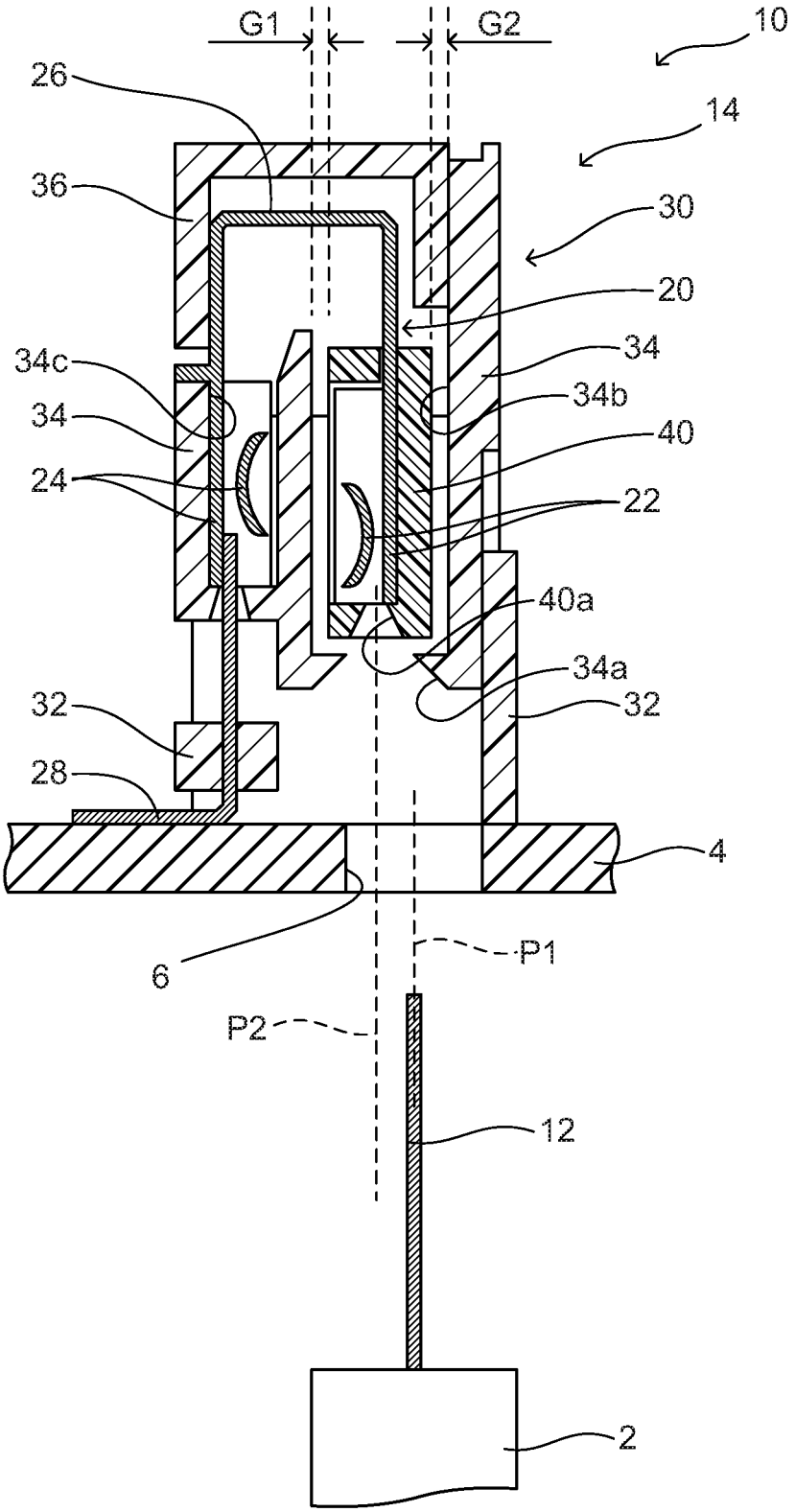
FIG. 3 shows a variant of the connector structure 10 in which positions of an electrical component 2 and the female connector 14 with respect to a circuit board 4 are different as compared to FIG. 1.
Figure 4:
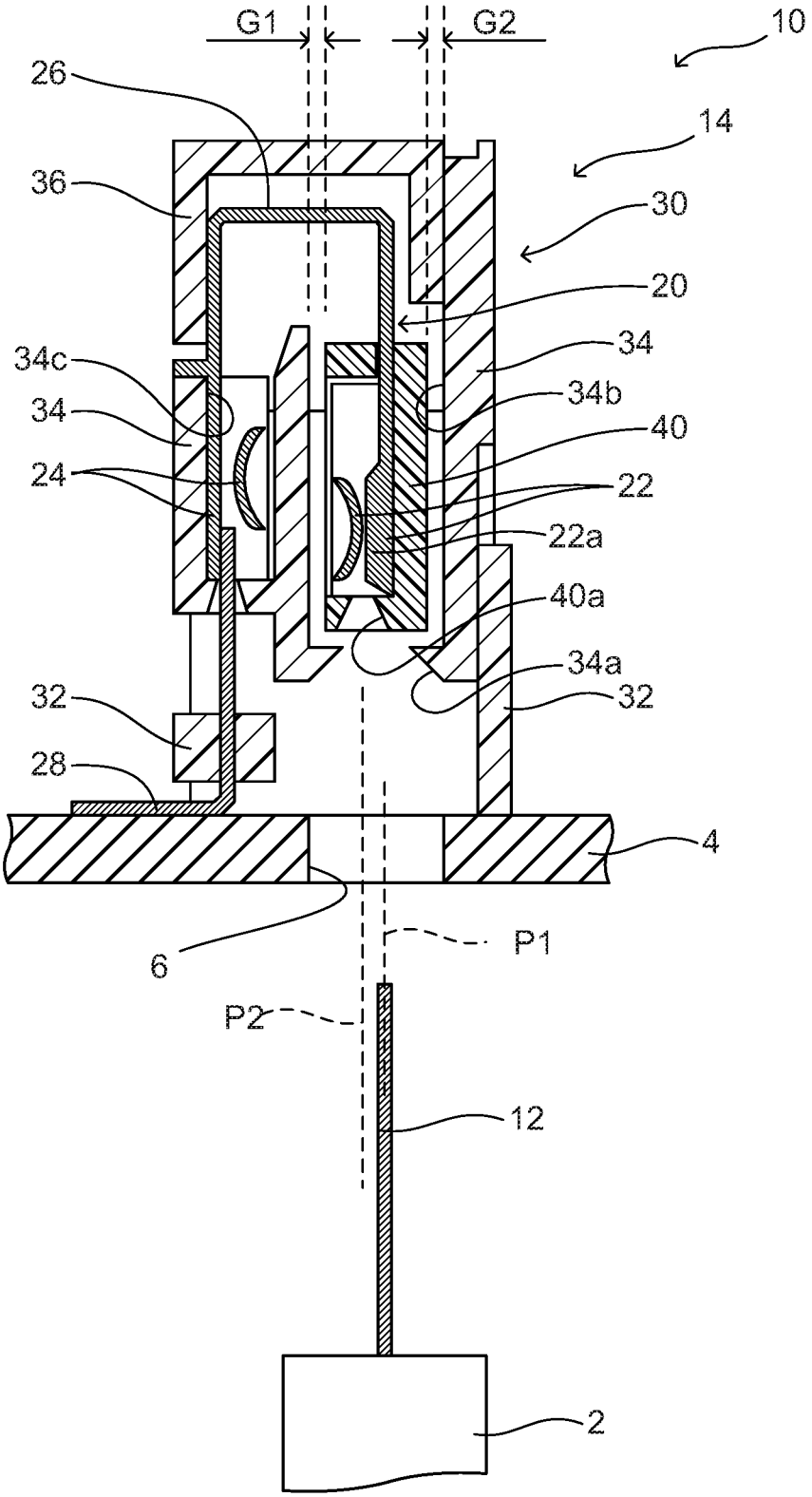
FIG. 4 shows another variant of the connector structure 10 in which a structure of a first female contact 22 is different as compared to FIG. 1.

In the embodiment described above, a position of the electrical component 2 including the male terminal 12 is adjusted with respect to the circuit board 4 in order to offset the position P1 of the male terminal 12 from the position P2 of the first female contact 22. As a result, the position P1 of the male terminal 12 is offset from the center of the opening 6 of the circuit board 4. Alternatively or additionally, as shown in FIG. 3, the position of the female connector 14 may be adjusted with respect to the circuit board 4. In this case, the position P2 of the first female contact 22 is offset from the center of the opening 6 of the circuit board 4. Alternatively, as shown in FIG. 4, the structure of the first female contact 22 may be changed, for example, by increasing a thickness of a base portion 22*a* to deform the male terminal 12 to be inserted.

In the embodiment described above, the male terminal 12 is inserted into the female connector 14 with the position P1 of the male terminal 12 offset from the position P2 of the first female contact 22. On the other hand, the male terminal 12 may be inserted into the female connector 14 with the position P1 of the male terminal 12 aligned with the position P2 of the first female contact 22. In this case, after the male terminal 12 is inserted into the female connector 14, the electrical component 2 may be displaced with respect to the circuit board 4 in the direction parallel to the circuit board 4.

In the embodiment described above, the contact sleeve 40 and the connector housing 30 are constituted of resin. According to such a configuration, an appropriate friction force can be generated between the contact sleeve 40 and the connector housing 30. In addition, generation of foreign matter caused by friction is relatively small. However, as another embodiment, one or both of the contact sleeve 40 and the connector housing 30 is not limited to being constituted of resin and may be constituted of other insulators. For example, materials used for the contact sleeve 40 and the connector housing 30 can be appropriately selected according to the target friction force FF.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

What is claimed is:

1. A connector structure configured to electrically connect an electrical component to a circuit board, the connector structure comprising:
- a female connector secured to the circuit board; and
- a male terminal extending from the electrical component and inserted into the female connector, wherein the female connector comprises:
- a connector housing secured to the circuit board;
- a connector-side terminal located within the connector housing and including a female contact configured to receive the male terminal; and
- a contact sleeve located within the connector housing and secured to the female contact, the female contact is displaceable within the connector housing, and the male terminal is elastically deformed so as to press the contact sleeve against a frictional inner surface of the connector housing by a restoring force of the male terminal.

2. The connector structure according to claim 1, wherein
- an opening is provided in the circuit board, and
- the male terminal is inserted into the female connector through the opening.

3. The connector structure according to claim 1, wherein the connector-side terminal comprises:
- a distal end portion at which the female contact is provided;
- a proximal end portion secured to the connector housing; and
- a plate spring portion extending between the distal end portion and the proximal end portion.

4. The connector structure according to claim 3, wherein the plate spring portion has a U-shape.

5. The connector structure according to claim 1, wherein the contact sleeve is constituted of resin.

6. The connector structure according to claim 1, wherein the connector housing is constituted of resin.

7. The connector structure according to claim 1, wherein the connector housing comprises:
- a base housing secured to the circuit board; and
- a main housing slidable with respect to the base housing.

8. The connector structure according to claim 7, wherein the connector-side terminal comprises a proximal end portion that is secured to the main housing.

9. The connector structure according to claim 8, wherein the connector-side terminal further comprises:
- a distal end portion at which the female contact is provided; and
- a plate spring portion extending between the distal end portion and the proximal end portion.

10. The connector structure according to claim 1, wherein
- the connector housing further comprises another inner surface opposing to the frictional inner surface,
- the male terminal comprises a base end portion that is secured to the electrical component and a tip end portion that is in contact with the female contact, and
- the male terminal is elastically bent toward the another inner surface in a direction from the base end portion to the tip end portion.

* * * * *